United States Patent [19]

Birt

[11] 4,190,915

[45] Mar. 4, 1980

[54] BED CLOTHING SUPPORT

[76] Inventor: Isobel J. Birt, 100 Indian Trail, Williamsville, N.Y. 14221

[21] Appl. No.: 879,093

[22] Filed: Feb. 21, 1978

[51] Int. Cl.[2] ..... A47C 21/00

[52] U.S. Cl. ..... 5/505

[58] Field of Search ..... 5/92, 317, 319–321, 5/331, 362

[56] References Cited

U.S. PATENT DOCUMENTS

| | | | |
|---|---|---|---|
| 590,005 | 9/1897 | Goodwin | 5/320 |
| 755,699 | 3/1904 | Robertson | 5/319 |
| 2,903,715 | 9/1959 | Westgard | 5/319 |
| 4,074,373 | 2/1978 | Ganofalo | 5/317 R |

*Primary Examiner*—Casmir A. Nunberg

*Attorney, Agent, or Firm*—Christel, Bean & Linihan

[57] ABSTRACT

A bed clothing support comprising a strap of fabric or like material adapted to span the distance between the side rails of a bed and provided with Velchro or like fasteners at each end for releasable connection of the strap ends to the upper portions of the bed side rails. The strap when connected to the side rails is located above the body of a person occupying the bed, and bed clothing is supported over and on the strap. Preferably two straps are connected to the side rails and are disposed in spaced, generally parallel relation over the foot and leg area of the occupant. The strap is particularly advantageous on hospital beds, having the attributes of patient comfort and safety and convenience in use and storage.

8 Claims, 3 Drawing Figures

BED CLOTHING SUPPORT

BACKGROUND OF THE INVENTION

This invention relates to the art of bed attachments and accessories, and more particularly to a new and improved bed clothing support.

One area of use of the present invention is supporting bed clothing above the body of the occupant of a hospital bed, although the principles of the present invention can be variously applied. It is necessary to alleviate pressure from bed linens on the lower extremities of certain patients, for example those having edemateous feet and legs and those recovering from burns, and heretofore metal bed cradles have been employed. Such metal bed cradles have the disadvantages of being relatively heavy and cumbersome and consequently a safety hazard to the patient along with being an effort to install and store.

SUMMARY OF THE INVENTION

It is, therefore, a primary object of the present invention to provide a new and improved bed clothing support.

It is a further object of this invention to provide such a bed clothing support having a structure which is both sufficiently strong to support bed clothing and safe for use with medical patients.

It is a further object of this invention to provide such a bed clothing support which is relatively light in weight and convenient to install and also to store when not in use.

It is a further object of this invention to provide such a bed clothing support which is of relatively low cost to manufacture.

The present invention provides a bed clothing support for use with a bed having a pair of opposite side rails and comprising an elongated strip member having a length sufficient to span the distance across the bed between the side rails with the opposite end portions of the strip member extending around the upper portions of the side rails and then inwardly and fastening means adjacent each end of the strip member for providing a releasable connection of each of the strip member end portions to the corresponding side rail upper portion. The strip member is located in spaced relation to the bed supporting surface above the body of the occupant and is disposed generally laterally with respect to the occupant, and bed clothing is placed over and on the strip member so as to be supported above the body of the occupant. Preferably two strip members are connected to the bed side rails and are disposed in spaced, generally parallel relation over the foot and leg area of the occupant. The strip member is of a light weight material which is sufficiently strong to support the weight of bed clothing and which is sufficiently flexible to permit the strip member end portions to extend around and then inwardly relative to the side rail upper portions. The fastening means comprises a pair of elongated mating fasteners adjacent each end of the strip member and engagable at selectable locations along the strip, for example Velchro hoop and loop tape type fasteners, providing a degree of longitudinal accommodation or variation in the location of the connection. The bed clothing support is particularly advantageous for use on hospital beds, being light in weight and simple in construction so as to be safe for patients and also being convenient and easy to install and to store when not in use.

The foregoing and additional advantages and characterizing features of the present invention will become clearly apparent upon a reading of the ensuing detailed description together with the included drawing wherein:

BRIEF DESCRIPTION OF THE DRAWING FIGURES

DETAILED DESCRIPTION OF THE ILLUSTRATED EMBODIMENT

Figure 1:
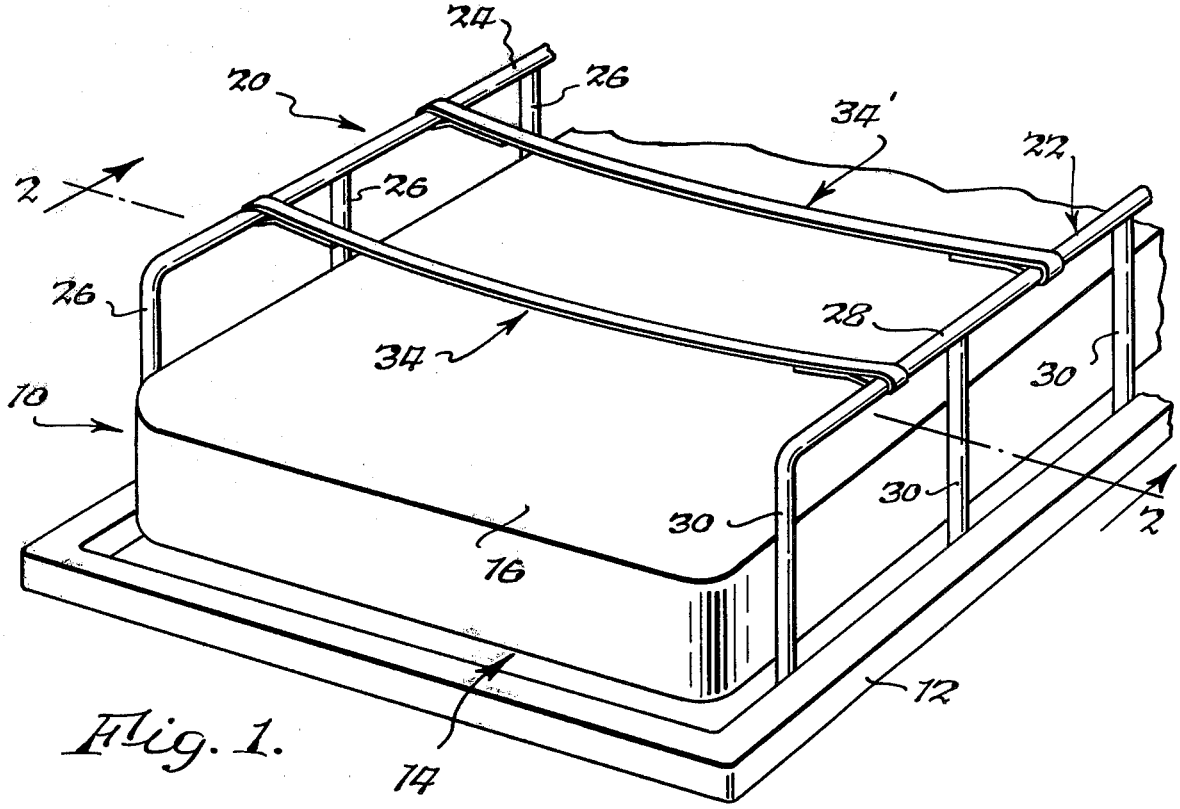
FIG. 1 is a fragmentary prospective view of a bed provided with the bed clothing support according to the present invention.

FIG. 1 illustrates a portion of a bed generally designated 10 viewed from one end, for example the foot end, which bed includes a frame 12 of generally rectangular shape which is adapted to be supported in elevated relation to a floor or like supporting surface by additional supporting framework (not shown) in a known manner. A mattress 14 having a substantially planar upper surface 16 for supporting the person occupying bed 10 is supported by frame 12 in a known manner. In use, surface 16 normally is disposed in a generally horizontal plane elevated from the floor. Bed 10 is of the type having a pair of side rail assemblies generally designated 20, 22 located on opposite sides of the bed, and in the bed shown in FIG. 1 the side rails 20, 22 are located adjacent the foot end thereof. The side rails or guards 20, 22 serve to prevent the occupant falling from the bed. While the bed clothing support of the present invention is described in conjunction with a hospital bed, it is applicable to any bed having opposed side rails located on the bed so that each rail is along one side of the occupant and where there is need to support the bed clothes relative to the occupant in a manner which will be described in detail presently.

Side rail 20 includes a generally horizontal upper portion 24 which in the present illustration is generally tubular in cross-section and it includes a plurality of vertical members 26 in spaced relation along the bed. Each of the vertical members is supported at the lower end thereof in the bed frame 12 and joins the horizontal portion 24 at the upper end of the leg. Similarly, side rail 22 includes a generally horizontal upper portion 28 also tubular in cross-section and a plurality of vertical leg portions 30 each being connected at the lower end thereof to the bed frame and joining the horizontal portion 28 at the upper end of the leg. The side rails 20, 22 are disposed in generally spaced apart parallel relation each in turn being generally parallel to the longitudinal axis of the bed frame. The side rails 20, 22 also can be individually vertically adjustable in a known manner. The vertical members 26 and 30 of the rails 20 and 22, respectively, are of sufficient length such that each of the upper portions 24 and 28, respectively, normally will be located in a horizontal plane spaced vertically upwardly from the occupant supporting surface 16 of mattress 14.

In accordance with the present invention, the bed clothes including bed linens and blankets are held or supported relative to the body of the person occupying the bed by a bed clothing support in the form of an elongated strip member generally designated 34. Strip 34 has a relatively narrow width and has a length sufficient to span the distance across the bed occupant supporting surface 16 between the bed side rails or guards 20, 22. Strip 34 is releasably connected at each end to a corresponding one of the upper portions 24 and 28 of the side rails 20 and 22, respectively. As a result, strip 34 extends transversely of the bed 10, is located in spaced relation to the mattress upper surface 16, and is disposed in a plane generally parallel to the plane of the mattress upper surface 16. The manner in which strip 34 is releasably connected or fastened at the opposite or terminal ends to the bed side rails will be described in detail presently. Strip 34 as shown in FIG. 1 is connected to the side rails 20, 22 at a location so as to be generally above the area of the bed 10 supporting the feet of the occupant. Typically another identical bed clothing support 34' is releasably connected to the bed side rails in an identical manner at a spaced location from strip 34 so as to be generally near and above the calf area of the occupant's legs. As a result, the two bed clothing supports 34, 34' are located above the lower extremities of a person occupying the bed.

Figure 2:
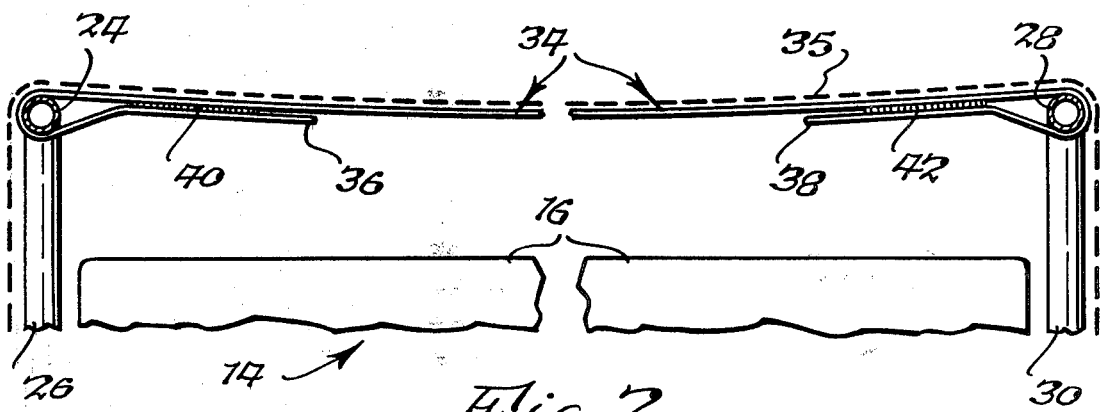
FIG. 2 is a fragmentary sectional view taken about on line 2—2 of FIG. 1 showing the bed clothing support of the present invention as it appears when supporting bed clothing.

Referring now to FIG. 2, an item of bed clothing designated 35, for example a sheet, is placed over and on the strip member 34 so as to be supported above the body of the occupant in a manner which will be described in further detail presently. Strip member 34 terminates in a pair of opposite terminal end edges 36, 38 which in the device shown are disposed generally perpendicular to the longitudinal axis of strip 34. Strip 34 is of sufficient length such that it not only can span the distance between side rails 20, 22 but also can be placed around the side rail upper or horizontal portion at each end of the strip 34 and then extend inwardly for some distance as shown in FIG. 2. In the bed clothing support shown, each end portion of strip 34 extends inwardly along the portion of the strip 34 which spans the distance between the rail assemblies 20, 22 and each end portion so extends over a length which is relatively short compared to the distance between the rail assemblies. In addition, the inwardly extending end portions are relatively closely spaced to the other portion of strip 34 as shown in FIG. 2, with each terminal end portion being disposed in a plane generally parallel to the plane of the adjacent portion of strip 34 spanning the distance between the rails 20, 22.

Figure 3:
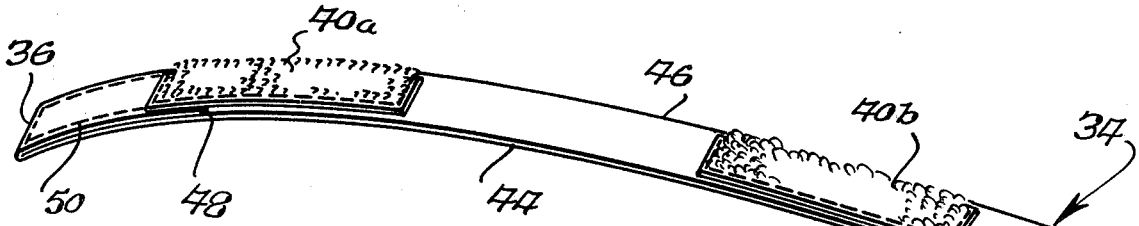
FIG. 3 is a fragmentary prospective view of one terminal end of the bed clothing support of the present invention.

Strip member 34 is provided with fastening means adjacent each end thereof, in particular fastening means generally designated 40 adjacent the terminal end 36 and fastening means generally designated 42 adjacent the terminal end 38. Each fastening means serves to provide a releasable connection between the corresponding portion of strip 34 adjacent eacn end which extends inwardly relative to the side rails and a portion of the strip 34 which spans the distance between side rails 20, 22. This is illustrated in further detail in FIG. 3 which shows one terminal end portion of strip 34, in particular the portion adjacent the terminal end 36. The strip member 34 is bounded by a pair of spaced-apart side edges 44, 46 disposed generally parallel along the entire length of strip 34. The terminal end 36 is defined by a folded over portion of strip 34 which terminates in an edge 48 located a short distance inwardly of end 36. This folded over or doubled end of strip 34 is secured by stitching 50 or the equivalent. The fastening means 40 comprises a first mating fastener element **40*a* secured to the surface of strip 34 a relatively short distance from terminal end 36 and a second mating fastener element 40*b* secured to the same surface of strip 34 spaced from fastener 40*a* a predetermined distance along strip 34 in a direction away from terminal end 36. This spacing or distance is sufficient to allow the portion of strip 34 between the fasteners 40*a*, 40*b* to extend around the corresponding side rail upper portion so that the two fasteners 40*a*, 40*b* can be engaged. The longitudinal spacing between fasteners 40*a*, 40*b* is predetermined according to the cross-sectional size of the side rail upper portions which size typically is standard for hospital beds. The fastening means 42 adjacent the opposite terminal end of strip 34** comprises an identical arrangement of longitudinally spaced mating fastener elements.

The elongated mating fastening elements **40*a*, 40*b* adjacent the one end of strip 34 and the identical mating elements of fastening means 42 adjacent the opposite end are of the type which are engageable at selective various locations along the portion of the strip 34 to which the fastening element is secured. As a result, there is a degree of selectivity or variation in the relative positions between the mating fastener elements, for example elements 40*a*, 40*b*, in a longitudinal direction at which the fastening elements are engageable for connection or attachment. In other words, and referring to FIG. 3, fastening elements 40*a*, 40*b* can be brought together for engagement with the opposite end edges of element 40*a* in alignment with the opposite end edges of element 40*b* or longitudinally displaced somewhat relative to each other in either direction so long as at least a sufficient portion of the surface area of one fastening element contacts or engages a sufficient portion of the surface area of the mating fastening element. For example, fastening elements 40*a*, 40*b* can be brought together with the edge of fastener 40*a* nearest end 36 being in alignment with the inner edge of fastener 40*b* which is nearest the central portion of strip 34, or the fastening elements 40*a*, 40*b* can be brought together with that same edge of fastener 40*a* displaced longitudinally either toward the central portion of strip 34** or in the opposite direction. As a result, there is not just one discrete positional relationship between the mating fastening elements but rather a number of relative longitudinal relative positions at which they can be engaged. This is advantageous in accommodating some variations among different beds in distance between bed side rails and in cross-sectional size of side rail upper members. One form of fastening means which is particularly desirable in having the foregoing characteristics and in being convenient and easy to operate is the plastic hoop and loop tape type fastener available under the registered trademark Velcro of American Velcro, Inc. Other suitable types of fasteners can of course be employed.

The material of strip member 34 is of a type having sufficient flexibility so as to be easily placed around the bed side rail upper portions in the manner shown in FIG. 2 while also being non-stretchable in a longitudinal direction. The material also should have adequate strength to support the weight of bed clothing. In addition, the strip member 34 should have sufficient rigidity at least in the region of the end portions so that the inwardly extending ends thereof are disposed closely adjacent the remainder of the strip member to cover any exposed areas of the fasteners 40, 42. Such rigidity is enhanced by the folded over or doubled end section illustrated in FIG. 3. Various disposable or non-disposable washable materials can be employed. For example, one material found to perform satisfactorily is the woven fabric material commercially available as belt stiffening material which is washable and to which the Velcro type fasteners can be attached by sewing or stitching. Commercially available belt stiffening material typically has the following composition by weight: 58% Nylon, 17% Rayon, 15% polyester and 10% thermoplastic resin. An example of disposable material found to perform satisfactorily is the synthetic material used in the manufacture of hospital wrist restraints commercially available from American Hospital Supply Co. The Velchro type fasteners can be attached to this material by sewing or stiching.

By way of example, an illustrative bed clothing support 34 is about 55 inches long and 1½ inches wide. The outermost Velchro fastener located nearest the terminal end of the strip 34 is spaced about 2 inches inwardly from the end. Each Velchro fastener is about 4 inches long and ¾ inch wide. The spacing between fasteners, for example between fasteners 40*a* and 40*b* is about 4 inches.

In use, the bed clothing support of the present invention is installed on a bed prior to placement of the bed clothes such as sheets and blankets. The strip member 34, which may also be called a bed cradle strap, is connected at one end to a corresponding one of the bed side rails, for example as shown in FIG. 2 the end of strip member 34 containing fastening means 40 is connected to upper portion 26 of side rail 20. In particular, the end portion with fasteners 40*a*, 40*b* facing downward or toward the mattress 14 is placed by hand on side rail portion 26 with the longitudinal section of strip 34 between fasteners 40*a*, 40*b* contacting the upper surface of side rail portion 26, fastener 40*b* being inwardly of portion 26 and fastener 40*a* being outwardly thereof relative to the bed. Then the portion of the terminal end containing fastener 40*a* is manipulated so as to be moved or brought underneath side rail portion 26, in effect wrapping the portion partially around side rail portion 26, whereupon the upwardly facing fastener element 40*a* is brought into mating contact or engagement with the downwardly facing fastener element 40*b*. The two fasteners 40*a*, 40*b* are manually pressed together to effect a fastened connection as shown in FIG. 2, this being the typical manner of engaging Velchro type fasteners. This end of bed clothing support thus is connected in a looped or wrapped around manner to the upper portion 26 of bed side rail 20. Then the strip member 34 is drawn or pulled by hand laterally across the bed, spanning the distance between the bed side rails 20, 22 whereupon the opposite terminal end portion containing fastening means 42 is connected manually in an identical manner to upper portion 28 of side rail 22. This end is connected or fastened in a manner drawing the strip member 34 relatively taut between the side rail assemblies 20, 22. This advantageously is facilitated by the nature of the fasteners as described hereinabove whereby the engagability of the mating fasteners at several relative longitudinal positions accommodates variations among beds in distance between side rails and size of side rail upper sections. Should any portion of one of the fastener elements not be completely covered by the mating fastener element, it is covered by the opposed section of the strip member 34 due to the rigidity in the end portion as described above. This is particularly important in hospital use for preventing the fastener surface from catching or scratching the occupant's skin or any bandages or surgical dressings on the occupant's body.

Thus the strip member 34 is connected at opposite ends to the upper portions of the bed side rails 20, 22, is disposed at about right angles to the bed sides and to the longitudinal axis of the bed, and lies substantially in a plane generally parallel to the bed occupant supporting surface 16 which typically is generally horizontal during use. Usually two bed clothing supports 34 and 34′ are installed on a single bed as illustrated in FIG. 1. The same procedure is followed for installing each support 34, 34′, and the two supports are in spaced generally parallel relation near the foot end of the bed. In particular, the one support 34 shown in FIG. 1 is located generally above the foot area of the bed occupant and the other support 34′ is located generally above the occupant's calves. The two supports 34, 34′ are disposed in substantially the same plane which lies generally parallel to the occupant supporting surface 16.

With one or both supports installed in place, the bed clothing then is placed over and on the supports as illustrated in FIG. 2. The sides of the sheets and/or blankets extend down along the outer surfaces of the side rails 20, 22 to the lower region of the bed where they can be anchored or tucked in according to conventional procedures. As a result, the bed clothing is supported or held relative to the body of the person occupying the bed thereby relieving pressure from bed clothing on the occupant's lower extremities. The bed clothing is held upwardly by the bed clothing support which extends underneath the bed clothes, i.e. between bed clothes and occupant, and there is no mechanical connection or engagement, just a supporting contact, between the support and the bed clothing. This is of particular importance for hospital beds occupied by persons recovering from leg and foot injuries. In particular, supporting the bed clothing relative to a portion of the occupant's body provides comfort, prevents further injury and gives the added advantage of increased air circulation around that portion of the occupant's body.

The foregoing is accomplished by a bed clothing support of simple construction which is convenient and easy to use. The light weight material and simple construction make the bed clothing support completely safe for use with hospital patients. In this connection, each bed clothing support 34 is a unitary or integral item with substantially smooth continuous outer surfaces and no portion of the fasteners being exposed to the patient when in use. It is not heavy and cumbersome in contrast to conventional metal bed cradles. Furthermore, the simple construction has the added advantage of low manufacturing cost. In addition, the bed clothing support is easily removable from a bed, simply by manual disengagement of the fasterers at each end. With the Velchro type fasteners described above, the ends 36 and 38 are simply grasped by hand and pulled downwardly and toward the side rails to separate the mating fastener strips. Each bed clothing support 34 can be folded or coiled like tape for convenient storage until further use. Such re-usable forms would be of washable material such as the afore-mentioned belt stiffening material. Alternatively, the bed clothing supports can be of disposable material and discarded after use.

It is therefore apparent that the present invention accomplishes its intended objects. While a single embodiment of the present invention has been described in detail, this is for the purpose of illustration, not limitation.

I claim:

1. A bed clothing support for use with a bed having an occupant supporting surface and a pair of opposite side rail assemblies located on said bed so that each rail assembly is located along one side of the occupant, each of said side rail assemblies having an upper portion normally located in a plane above said occupant supporting surface, said bed clothing support comprising:

(a) an elongated strip member having a length sufficient to span the distance across said occupant supporting surface between said side rail assemblies and with the opposite end portions of said strip member extending around the corresponding ones of said side rail upper portions and then extending further inwardly along the portion of said strip member spanning the space between said rail assemblies;

(b) said strip member being of a light weight material which is sufficiently strong to support the weight of bed clothing and which is sufficiently flexible to permit said strip member end portions to extend around and then inwardly relative to said side rail upper portions, said strip member having a surface for providing supporting contact with the bed clothing with no mechanical connection to the bed clothing; and (c) fastening means adjacent each end of said strip member, each of said fastening means providing a releasable connection between the corresponding portion of said strip member which extends inwardly from the corresponding side rail and the portion of said strip member which spans the distance between said side rail assemblies so as to provide a releasable connection of each of said strip member end portions to the corresponding one of said side rail upper portions, said fastening means comprising a pair of mating fastening elements adjacent each end of said strip member, one of said fastening elements of each pair being located relatively near the corresponding end of said strip member and the other mating fastening element of each pair being spaced from said one fastening element longitudinally along said strip in a direction away from the corresponding end, the distance between said mating fastening elements being sufficient to permit the portion of said strip between said fastening elements to extend around said side rail upper portions with said mating fastening elements engaging each other inwardly of said side rail, each of said fastening elements being in the form of an elongated strip, said fastening elements being engagable at selectable various locations lengthwise along the portion of said strip member where the corresponding fastening element is located to accomodate some variations in dimensions and sizes of various beds;

(d) whereby said strip member is located in spaced relation to said bed supporting surface above the body of the occupant and is disposed generally laterally with respect to the occupant and bed clothing is placed over and on said strip member so as to be supported above the body of the occupant.

2. A bed clothing support according to claim 1, wherein said strip member is of fabric material.

3. A bed clothing support according to claim 1, wherein said strip member is of disposable synthetic material.

4. A bed clothing support according to claim 1, wherein said mating fastening elements are in the form of Velcro hoop and loop tape type fasteners.

5. A bed clothing support according to claim 1, wherein said strip member has sufficient rigidity at least in the region of said end portions so that each of said end portions remains closely spaced to the portion of said strip member spanning between said side rails when said mating fasteners are engaged so that any portion of a fastening element not covered by the mating fastener element is covered by the opposed section of said strip member.

6. In combination with a bed having an occupant supporting surface and a pair of opposite side rail assemblies located on said bed so that each rail assembly is located along one side of the occupant and each of said side rail assemblies having an upper portion normally located in a plane above said occupant supporting surface, a bed clothing support comprising:

(a) a continuous elongated strip member spanning the distance across said occupant supporting surface between said side rail assemblies and having the opposite end portions of said strip member extending around the corresponding ones of said side rail upper portions and then extending inwardly relative to said side rail upper portions;

(b) said strip member being of a light weight flexible material which is sufficiently strong to support the weight of bed clothing and which is substantially nonstretchable in a longitudinal direction, said strip member having a surface for providing supporting contact with the bed clothing with no mechanical connection to the bed clothing; and (c) fastening means adjacent each end of said strip member, each of said fastening means providing a releasable connection between the corresponding portion of said strip member which extends inwardly from the corresponding side rail and the portion of said strip member which spans the distance between said side rail assemblies so as to releasably connect each of said strip member end portions to the corresponding one of said side rail upper portions, said fastening means comprising a pair of mating fastening elements adjacent each end of said strip member, one of said fastening elements of each pair being located relatively near the corresponding end of said strip member and the other mating fastening element of each pair being spaced from said one fastening element longitudinally along said strip in a direction away from the corresponding end, the distance between said mating fastening elements being sufficient to permit the portion of said strip between said fastening elements to extend around said side rail upper portions with said mating fastening elements engaging each other inwardly of said side rail, each of said fastening elements being in the form of an elongated strip, said fastening elements being engagable at selectable various locations lengthwise along the portion of said strip member where the corresponding fastening element is located to accomodate some variations in dimensions and sizes of various beds;

(d) said strip member having sufficient rigidity at least in the region of said end portions so that each of said end portions remains closely spaced to the portion of said strip member spanning between said side rails when said mating fasteners are engaged so that any portion of a fastening element not covered by the mating fastener element is covered by the opposed section of said strip member;

(e) whereby said strip member is located in spaced relation to said bed supporting surface above the body of the occupant and is disposed generally laterally with respect to the occupant and bed clothing is placed over an on said strip member so as to be supported above the body of the occupant.

7. The combination according to claim 6 further including a second bed clothing support identical to said first-named support, said second support spanning the distance across said occupant supporting surface and releasably connected at opposite ends to corresponding ones of said side rail upper portions, said bed clothing supports being in spaced-apart generally parallel relation and located so as to be generally above the lower extremities of an occupant of said bed.

8. The combination according to claim 6, wherein said mating fastening elements are in the form of Velcro hoop and loop tape type fasteners.

* * * * *